US006712253B2

(12) United States Patent
Hargrave et al.

(10) Patent No.: US 6,712,253 B2
(45) Date of Patent: Mar. 30, 2004

(54) APPARATUS AND METHOD FOR DISPENSING TICKETS

(75) Inventors: Jack F. Hargrave, Council Bluffs, IA (US); Terry L. Poffenbarger, Council Bluffs, IA (US); Benny D. Childers, Council Bluffs, IA (US); Marty E. Johnson, Council Bluffs, IA (US); Michael T. Templeman, Council Bluffs, IA (US)

(73) Assignee: American Games, Inc., Council Bluffs, IA (US)

( * ) Notice: Subject to any disclaimer, the term of this patent is extended or adjusted under 35 U.S.C. 154(b) by 243 days.

(21) Appl. No.: 09/873,811

(22) Filed: Jun. 4, 2001

(65) Prior Publication Data

US 2002/0179668 A1 Dec. 5, 2002

(51) Int. Cl.[7] ..... B26D 1/04

(52) U.S. Cl. ..... 225/100; 83/364; 225/9; 225/28; 225/71

(58) Field of Search ..... 225/11, 12, 21, 225/22, 37, 60, 63, 67, 75, 79, 82, 85, 9, 23, 28, 71, 100, 4; 83/74, 364, 369

(56) References Cited

U.S. PATENT DOCUMENTS

| | | | |
|---|---|---|---|
| 2,246,228 | A | 6/1941 | Winter |
| 2,252,720 | A | 8/1941 | Metzner |
| 2,328,582 | A | 9/1943 | Ratchford et al. |
| 2,492,497 | A | 12/1949 | Oakley et al. |
| 2,600,041 | A | 6/1952 | Wright |
| 2,613,742 | A | 10/1952 | McGhan et al. |
| 2,618,336 | A | 11/1952 | Davidson |
| 3,508,693 | A | 4/1970 | Rossi |
| 3,552,616 | A | 1/1971 | Mason |
| 3,734,261 | A | 5/1973 | Richer |
| 3,750,790 | A | 8/1973 | Cresswell-Clough |
| 3,859,880 | A | 1/1975 | Schackelford |

(List continued on next page.)

FOREIGN PATENT DOCUMENTS

| | | |
|---|---|---|
| DE | 3205801 | 8/1983 |
| DE | 3331982 | 3/1985 |
| DE | 3522022 | 1/1986 |
| EP | 0190629 | 1/1986 |
| EP | 0226327 | 6/1987 |
| EP | 0 325 516 A1 | 7/1989 |
| EP | 09267300 | 10/1997 |
| EP | 11259695 | 9/1999 |
| GB | 1521587 | 8/1978 |
| GB | 1534974 | 12/1978 |

(List continued on next page.)

OTHER PUBLICATIONS

Memorandum of Opinion and Order in re: *Interlott Technologies, Inc. v. Pollard Banknote Limited, et al.*; Case No. 1:02CV02157; 58 pages, filed Aug. 4, 2003.

*Primary Examiner*—Allan N. Shoap
*Assistant Examiner*—Phong Nguyen
(74) *Attorney, Agent, or Firm*—Hunton & Williams LLP

(57) ABSTRACT

A ticket machine for dispensing tickets from a strip of tickets having perforated joints is provided. The ticket machine includes a roller assembly, a detection mechanism and a bursting blade. The roller assembly adapted to communicate a portion of the strip of tickets along a ticket path. The detection mechanism is disposed adjacent the ticket path and adapted to determine the position of at least a leading ticket of the strip of tickets along the ticket path. The bursting blade is adjacent the ticket path and adapted to floatably strike the strip of tickets adjacent the perforated joints to separate at least the leading ticket from the strip of tickets. A method for separating tickets from a strip of tickets connected along perforated joints is also provided.

28 Claims, 8 Drawing Sheets

U.S. PATENT DOCUMENTS

| | | | | | |
|---|---|---|---|---|---|
| 3,888,399 | A | | 6/1975 | Hanson et al. | |
| 3,935,978 | A | | 2/1976 | Arp et al. | |
| 4,025,023 | A | | 5/1977 | Moffitt | |
| 4,069,957 | A | | 1/1978 | Moffitt | |
| 4,094,451 | A | | 6/1978 | Wescoat | |
| 4,118,022 | A | * | 10/1978 | Rayfield et al. | 270/52.12 |
| 4,140,259 | A | | 2/1979 | Kostka | |
| 4,157,670 | A | | 6/1979 | Herring | |
| 4,202,468 | A | | 5/1980 | Anderson et al. | |
| 4,261,497 | A | * | 4/1981 | Roetter et al. | 225/100 |
| 4,269,341 | A | | 5/1981 | Polko | |
| 4,284,221 | A | | 8/1981 | Nagel et al. | |
| 4,316,553 | A | | 2/1982 | Persson | |
| 4,367,666 | A | | 1/1983 | Toth | |
| 4,375,189 | A | * | 3/1983 | Berner et al. | 101/68 |
| 4,397,410 | A | | 8/1983 | Schueler | |
| 4,473,218 | A | | 9/1984 | Dudek | |
| 4,529,114 | A | | 7/1985 | Casper et al. | |
| 4,606,534 | A | | 8/1986 | Gombault | |
| 4,616,773 | A | | 10/1986 | Kerivan | |
| 4,623,081 | A | | 11/1986 | Hain | |
| 4,688,708 | A | | 8/1987 | Irvine et al. | 225/100 |
| 4,716,799 | A | | 1/1988 | Hartmann | |
| 4,818,854 | A | | 4/1989 | Davies et al. | |
| 4,982,337 | A | | 1/1991 | Burr et al. | |
| 5,141,142 | A | * | 8/1992 | Ramsey | 225/4 |
| 5,211,093 | A | * | 5/1993 | Horniak | 83/426 |
| 5,451,287 | A | * | 9/1995 | Marty | 156/446 |
| 5,536,008 | A | * | 7/1996 | Clapper, Jr. | 463/16 |
| 5,540,369 | A | * | 7/1996 | Boreali et al. | 225/4 |
| 5,622,302 | A | * | 4/1997 | Ring | 225/4 |
| 5,765,460 | A | * | 6/1998 | Wathieu | 83/37 |
| 5,836,498 | A | | 11/1998 | Turek | 225/1 |
| 5,950,898 | A | | 9/1999 | Menna | |

FOREIGN PATENT DOCUMENTS

| | | |
|---|---|---|
| GB | 2039265 | 1/1980 |
| GB | 1565970 | 4/1980 |
| GB | 2143356 | 2/1985 |
| GB | 2152482 | 8/1985 |
| GB | 2152908 | 8/1985 |
| WO | WO 83/04013 | 11/1983 |

* cited by examiner

FIG. 7
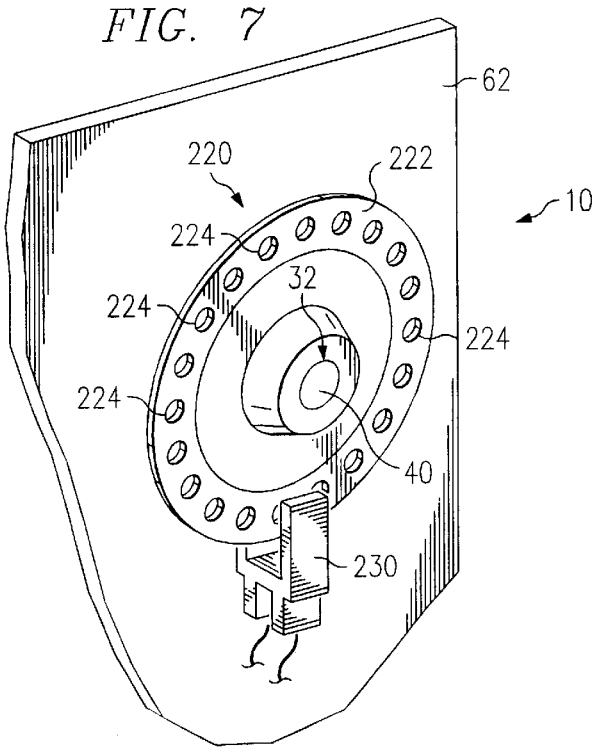
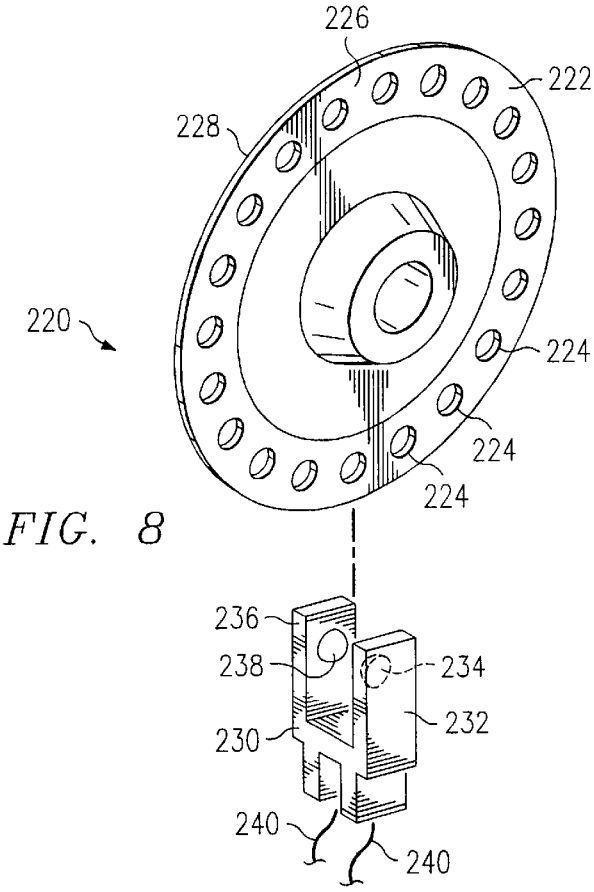
FIG. 8

APPARATUS AND METHOD FOR DISPENSING TICKETS

CROSS-REFERENCE TO RELATED APPLICATIONS

Not Applicable.

FEDERALLY SPONSORED RESEARCH OR DEVELOPMENT

Not Applicable.

BACKGROUND OF THE INVENTION

The present invention relates generally to a ticket vending machine for dispensing tickets, and more particularly, but not by way of limitation, to an apparatus and method for vending and dispensing tickets from a strip of tickets having perforated joints.

Consumer demand for tickets, such as lottery tickets, has risen dramatically in recent years. This demand has been met with a variety new and exciting games involving lottery tickets. The new breed of lottery ticket games has placed additional demands on the machines that dispense these lottery tickets since the new lottery tickets come in a wide variety of shapes and sizes.

The tremendous demand has produced lower quality lottery tickets causing tickets to be printed out of registration, perforations to be non-uniform or not completely punctured, and a variety of other printing imperfections and errors. Access to lottery tickets at a variety of convenient locations such as grocery stores, convenience stores, and other locations frequented by consumers has attempted to satisfy this demand. New machines for dispensing the new lottery tickets must be more flexible and intuitive than their predecessors.

These new machines, however, have failed dramatically in addressing these demands since the ticket machines must be capable of instant ticket vending by the consumer. Also, modern ticket dispensing machines are inadequate for handling mass-produced lottery tickets that are printed out of registration or have other imperfections. For this reason, modern ticket vending machines inevitably rip or tear tickets, or begin cutting the tickets at a predetermined length assuming the tickets are printed correctly which leads to tickets being cut improperly or in half which voids or ruins the tickets and aggravates the consumers and the vendors.

For this reason, a new and improved ticketing vending machine operable for dispensing tickets from a strip of tickets which overcomes these disadvantages is needed.

SUMMARY OF THE INVENTION

In one aspect, the present invention is directed to a ticket machine for dispensing tickets from a strip of tickets having perforated joints. The ticket machine includes a roller assembly, a detection mechanism and a bursting blade. The roller assembly is adapted to communicate a portion of the strip of tickets along a ticket path. The detection mechanism is disposed adjacent the ticket path and adapted to determine the position of at least a leading ticket of the strip of tickets along the ticket path. The bursting blade is adjacent the ticket path adapted to floatably strike the strip of tickets adjacent the perforated joints to separate at least the leading ticket from the strip of tickets.

In another aspect, the present invention provides a ticket dispenser for dispensing tickets from a strip of tickets connected along perforated joints. The ticket dispenser has a first and second stage rollers, a bursting blade and a positioning mechanism. The first stage rollers have a set of pinch rollers adapted to communicate the strip of tickets along a ticket path. The second stage rollers having a set of pinch rollers positioned along the ticket path and adapted to receive at least a first ticket of the strip of tickets communicated from the first stage rollers.

The bursting blade positioned adjacent the ticket path and adapted to strike the strip of tickets adjacent the perforated joints to break the perforated joints connecting at least the first ticket to the strip of tickets. The positioning mechanism is adapted to determine the position of the strip of tickets along the ticket path. The positioning mechanism is further adapted to communicate with the first and second stage rollers for positioning a perforated joint of the strip of tickets adjacent the bursting blade for separating at least the first ticket from the strip of tickets.

In yet another aspect, the present invention provides an instant ticket vending machine for dispensing tickets. The instant ticket vending machine includes a housing, a plurality of bins and a hopper. The housing is substantially rigid and has a door connected thereto the housing for providing access to an inner housing area of the housing. The housing is provided with an opening for retrieving dispensed tickets.

The plurality of bins are retained within the inner housing area of the housing and are adapted to dispense tickets from a strip of tickets connected by perforated joints. Each of the bins are provided with a first and second stage rollers, an optical sensor, an encoder and a bursting blade. The first stage rollers have at least a first shaft and a set of pinch rollers. The first stage rollers are adapted to communicate the strip of tickets along a ticket path.

The second stage rollers have a set of pinch rollers and is positioned along the ticket path. The second stage rollers are adapted to receive at least a first ticket of the strip of tickets communicated from the first stage rollers. The optical sensor is disposed adjacent the ticket path and adapted to sense the leading edge of at least the first ticket of the strip of tickets. The encoder is adapted to sense the rotation of the first shaft of the first stage rollers thereby determining a length of travel along the ticket path of at least the first ticket of the strip of tickets.

The bursting blade is disposed adjacent the ticket path and operable to float about a direction of travel of the strip of tickets along the ticket path. The bursting blade is adapted to floatably strike the strip of tickets adjacent the perforated joints to break the perforated joint connecting at least the leading ticket from the strip of tickets. The hopper is in communication with the opening in the housing and the plurality of bins such that the hopper is operative to receive tickets dispensed from the bins.

In one embodiment, the present invention provides a method for separating tickets from a strip of tickets connected along perforated joints. The method includes advancing the strip of tickets along a ticket path to an optical sensor and detecting, via the optical sensor, a leading edge of a first ticket of the strip of tickets. The method further provides for striking the strip of tickets along the ticket path near the perforated joint connecting the first ticket to the strip of tickets to breakingly separate the first ticket from the strip of tickets.

In another embodiment, the present invention provides a method for separating tickets from a strip of tickets connected along perforated joints. The method includes advancing the strip of tickets along a ticket path and detecting the leading edge of at least the first ticket of the strip of tickets. The method includes determining a ticket size of at least the first ticket of the strip of tickets and providing a tensioning mechanism operative to tension at least a portion of the ticket path at a perforated joint connecting at least the first ticket to the strip of tickets.

The method further includes providing a bursting blade adapted to float relative to a direction of travel of the strip of tickets along the path and positioning the strip of tickets relative to the bursting blade for separation. The method also provides for striking, via the bursting blade, the strip of tickets adjacent the tensioned portion of the ticket path adjacent the perforated joint connecting at least the first ticket to the strip of tickets to separate the first ticket from the strip of tickets.

Other objects, features, and advantages of the present invention will be apparent to those skilled in the art from the following detailed description when read in conjunction with the accompanying drawings and appended claims.

BRIEF DESCRIPTION OF THE DRAWINGS

For a more complete understanding of the present invention and the advantages thereof, reference is now made to the following brief description, taken in connection with the accompanying drawings and detailed description, wherein like reference numerals represent like parts, in which:

FIG. 7 is a perspective representation of an encoder connected to the ticket dispensing machine constructed in accordance with one embodiment of the present invention;

FIG. 8 is a perspective representation of the encoder shown in FIG. 7;

DETAILED DESCRIPTION OF THE INVENTION

It should be understood at the outset that although an exemplary implementation of the present invention is illustrated below, the present invention may be implemented using any number of techniques, whether currently known or in existence. The present invention should in no way be limited to the exemplary implementations, drawings, and techniques illustrated below, including the exemplary design and implementation illustrated and described herein.

Figure 1:
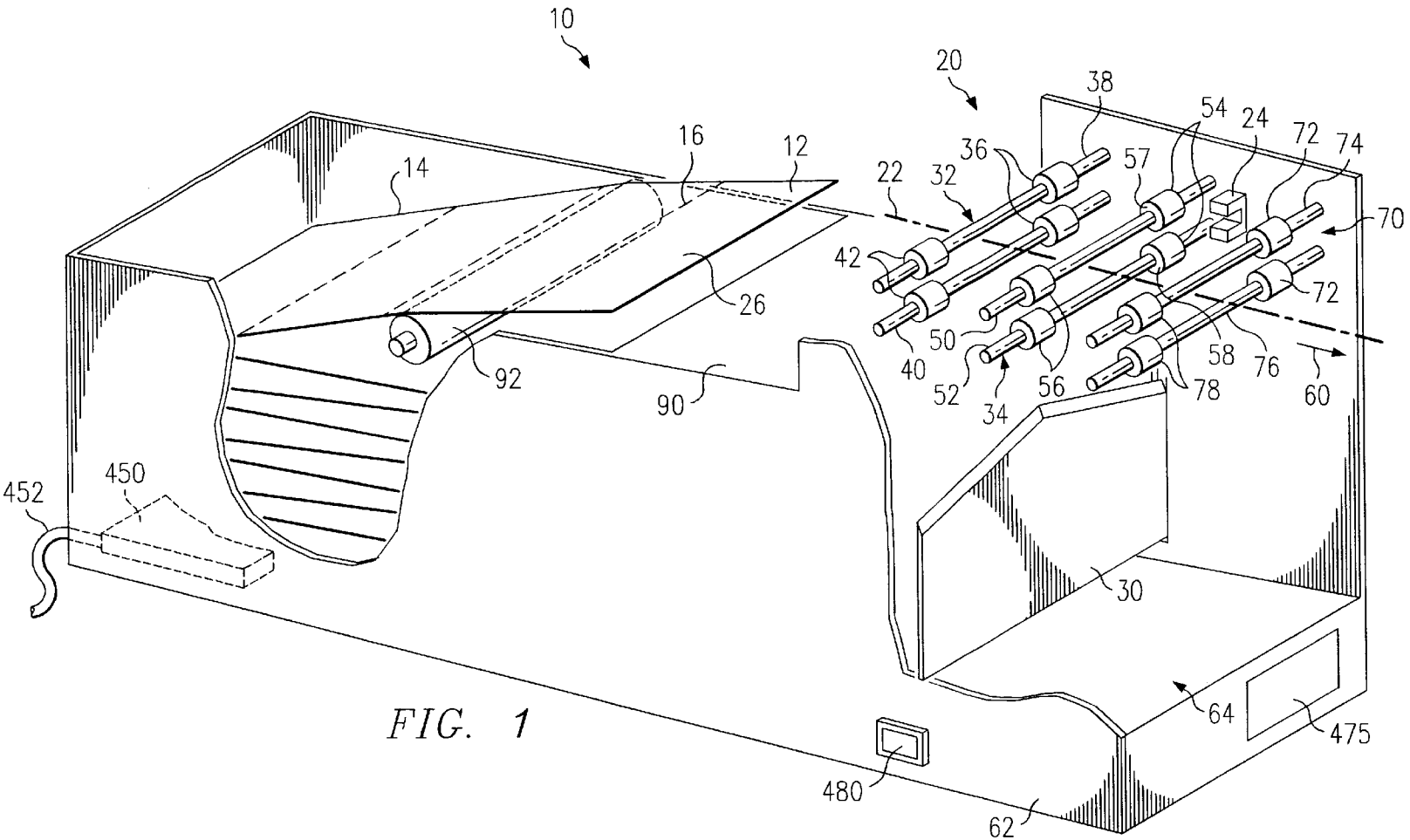
FIG. 1 is a perspective representation of a ticket dispensing machine constructed in accordance with one embodiment of the present invention.

FIG. 1 illustrates a perspective representation of a ticket dispensing machine 10 constructed in accordance with one aspect of the present invention. The ticket dispensing machine 10 of the present invention can be used for a variety of purposes to automatically dispense tickets 12, such as lottery and other tickets, to customers and patrons.

The ticket dispensing machine 10 is adapted to dispense tickets 12 from a strip of tickets 14 connected along a plurality of perforated joints 16. In one embodiment of the present invention, the ticket dispensing machine 10 includes a roller assembly 20 adapted to communicate a portion of the strip of tickets 14 along a ticket path 22 through the roller assembly 20.

The ticket machine 10 is further provided with a detection mechanism 24 disposed adjacent the ticket path 22 and adapted to determine the position of at least a leading ticket 26 of the strip of tickets 14 along the ticket path 22. The ticket machine further includes a bursting blade 30 disposed adjacent the ticket path 22 and adapted to floatably strike the strip of tickets 14 adjacent the perforated joints 16 so as to separate at least the leading ticket 26 from the strip of tickets 14.

In another embodiment, the ticket dispensing machine 10 is provided for dispensing tickets 12 from a strip of tickets 14 connected along perforated joints 16. The roller assembly 20, in the present embodiment, may include a first and second stage rollers 32 and 34. The first stage rollers 32 are provided with a set of pinch rollers 36 adapted to communicate the strip of tickets 14 along the ticket path 22. The pinch rollers 36 are disposed on an upper and lower shafts 38 and 40 of the first stage rollers 32.

The upper and lower shafts 38 and 40 are substantially cylindrical bars which may be constructed from a variety of materials, such as rigid polymeric or metallic materials and are operable for use for the purposes shown and disclosed herein. The pinch rollers 36 are standard rollers adapted to communicate materials, such as the strip of tickets 14 therebetween. The pinch rollers 36 may be constructed of rubber, polymeric or other materials well known in the art and used for such purposes.

The upper and lower shafts 38 and 40 may be provided with a plurality of grooves not shown for frictionally receiving the pinch rollers 36 about the upper and lower shafts 38 and 40. Additionally, the first stage rollers 32 may be provided with a second set of pinch rollers 42 oppositely disposed about the upper and lower shafts 38 and 40. The second set of pinch rollers 42 are substantially similar in construction and function to the pinch rollers 36 previously discussed.

The second stage rollers 34 are similarly provided with an upper and lower shafts 50 and 52 that are similarly provided with a set of pinch rollers 54 similar in construction and function to the pinch rollers 36 of the first stage rollers 32. In one embodiment, the pinch rollers 54 may include an upper roller 57 and a lower roller 58. In this embodiment, the upper roller 57 of the pinch rollers 54 may be advantageously adapted to idle along the upper shaft 50 while adapting the lower pinch roller 58 with one-way bearings (not shown) for one-way engagement with the strip of tickets 14. The second stage rollers 34 may further be provided with a second set of pinch rollers 56 to advantageously communicate the strip of tickets 14 along the ticket path 22.

In one embodiment, the pinch rollers 54 or the second set of pinch rollers 56 may be provided with one-way bearings as discussed above, not shown, to inhibit reverse travel of the strip of tickets 14 along a travel direction 60 along the ticket path 22. The one-way bearings are advantageous since frequently it is difficult to synchronize sets of rollers, such as the pinch rollers 36 and 42 of the first stage rollers 32 with the pinch rollers 54 and 56 of the second stage rollers 34. It will be appreciated that only the pinch rollers 54, an in one embodiment only the lower roller 58 are provided with one-way bearings for these purposes.

Furthermore, the use of one-way bearings in this manner is useful to account for varying motor speeds, roller or sprocket diameters, pulley sizes, and to prevent the strip of tickets 14 from jamming, buckling or otherwise undesirably moving along the ticket path 22.

The addition of one-way bearings in one or more of the pinch rollers 54 and 56 of the second-stage rollers 34 prevents synchronization errors between the first and second stage rollers 32 and 34 overcoming this problem. Furthermore, pinch rollers 54 and 56 of the second stage rollers 34 that are provided with one-way bearings provide the additional advantage of generating tension along the ticket path 22 of the strip of tickets 14 disposed between the first stage rollers 32 and the second stage rollers 34.

It should be understood that a variety of approaches in addition to the use of one-way bearings may be implemented and are well known in the art to achieve one-way rotation of any of the pinch rollers, such as pinch rollers 36.

It will be appreciated that the ticket dispensing machine 10 is provided with a housing 62 which may be constructed from a variety of materials, such as plastic or polymeric materials, steel, aluminum or other metals, which may be used for such purposes. In this manner, the roller assembly 20, which may include the first and second stage rollers 32 and 34, may be mounted to an interior area 64 near the front of the housing 62.

In other embodiments, the ticket dispensing machine 10 may be provided with a third-stage rollers 70 positioned down the ticket path 22 from the second-stage rollers 34 and operable for receiving the ticket 12 from the second stage rollers 34 and ejecting tickets 12. The third stage rollers 70 are substantially similar in construction and function to the second stage rollers 34 in that the third stage rollers 70 are provided with pinch rollers 72 disposed on an upper and lower shafts 74 and 76. The third stage rollers 70 may further be provided with a second set of pinch rollers 78 oppositely disposed from the pinch rollers 72.

One or more of the pinch rollers 72 and 78 of the third stage rollers 70 may be provided with one-way bearings not shown, which inhibit the strip of tickets 14 from reversing travel along the direction of travel 60 of the ticket path 22. In this manner, the third stage rollers 70 are advantageously adapted to receive one or more of the tickets 12 of the strip of tickets 14 and to eject the tickets 12 from the ticket dispensing machine 10. The one-way bearings eliminate, as previously discussed, synchronization problems between the second and third stage rollers 34 and 70, as well as, providing tension on the strip of tickets 14 along the ticket path 22.

The ticket dispensing machine 10, in one embodiment, may be provided with a tray 90 adapted to retain a plurality of tickets 12, such as the strip of tickets 14 which are commonly produced and distributed in an accordion-folded manner substantially as shown. The tray 90 of the ticket dispensing machine 10 may be provided with a roller 92 which may be constructed from nylon, polymeric, or other materials. The nylon roller 92 is operable to assist the unfolding and advancing of the strip of tickets 14 as it is advanced toward the roller assembly 20.

Figure 2:
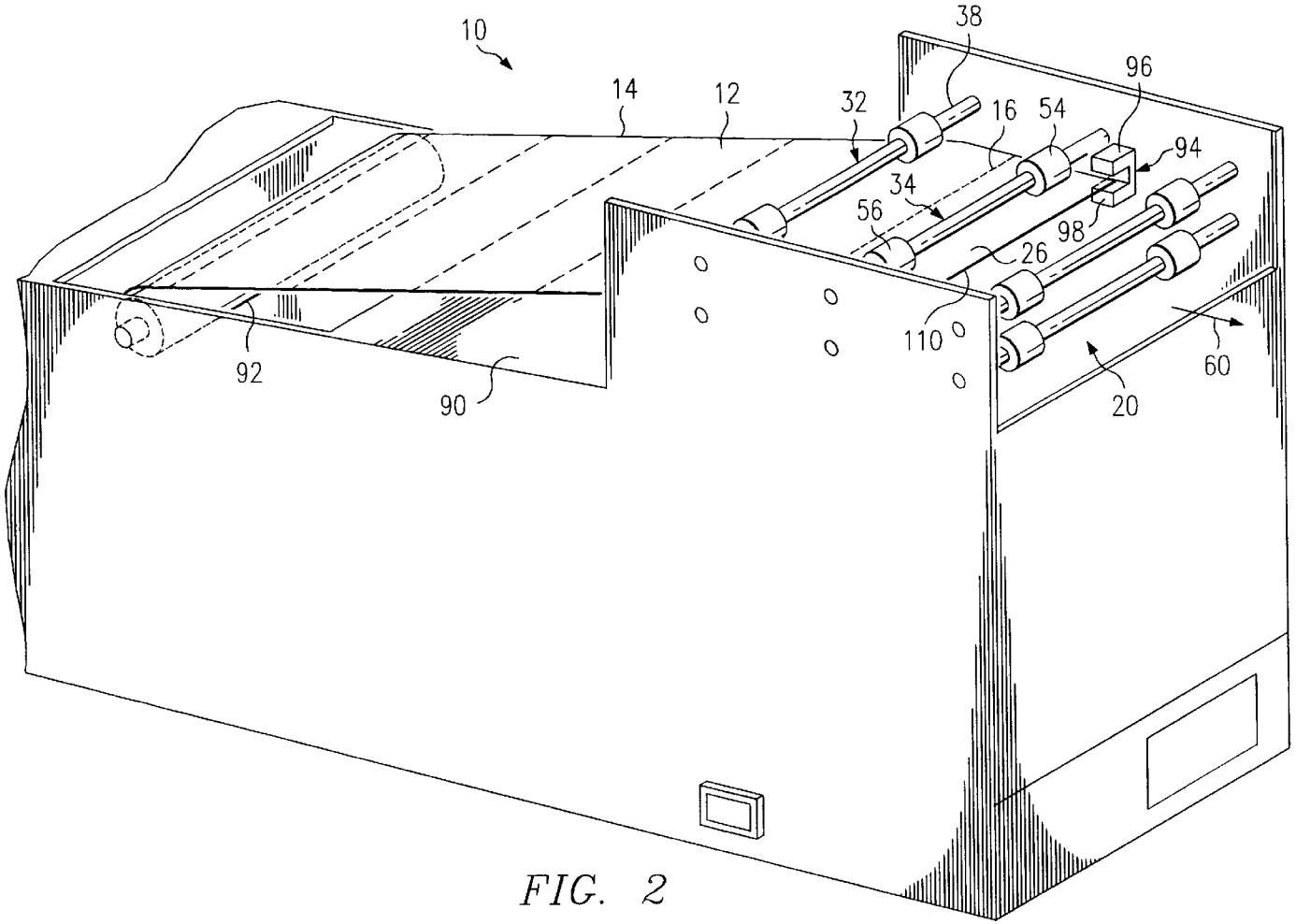
FIG. 2 is a top perspective view of the ticket dispensing machine provided with a strip of tickets in accordance with one embodiment of the present invention.

FIG. 2 shows the strip of tickets 14 advancing about the roller 92 and therethrough the roller assembly 20 in accordance with one embodiment of the present invention. In this embodiment, the detection mechanism 24, as shown in FIG. 1, is an optical sensor 94 having a first portion 96 disposed above the strip of tickets 14 and a second portion 98 disposed below the strip of tickets 14. In this manner, the optical sensor 94 is adapted to sense the strip of tickets 14 as it passes beyond the second stage rollers 34.

The optical sensor 94 may be provided, in one embodiment, with a light emitting diode, not shown, on the first portion 96 and a photo receptor, not shown, on the second portion 98, such that when the strip of tickets 14 interrupts the light emitting from the light emitting diode on the first portion 96, this interruption is detected by the photo receptor provided on the second portion 98. In this manner, the optical sensor 94 is adopted to detect, for example, the leading ticket 26 of the strip of tickets 14.

In operation, the strip of tickets 14 is passed over the roller 92 and is fed into the first stage rollers 32. The first stage rollers 32 pull the strip of tickets 14 from the tray 90 and advance the strip of tickets 14 toward the second stage rollers 34. As previously discussed, the strip of tickets 14 disposed between the first and second stage rollers 32 and 34 is substantially tensioned between the first stage rollers 32 and the second stage rollers 34 which have pinch rollers 54 and 56 provided with one-way bearings.

The strip of tickets 14 is then advanced through the first stage rollers 32 toward the second stage rollers 34 until the leading edge 110 of the leading ticket 26 is detected by the detection mechanism 24, or in this embodiment the optical sensor 94. In one embodiment, it may be beneficial to reverse the direction of travel 60 of the strip of tickets 14 once the leading edge 110 of the leading ticket 26 has been detected by the optical sensor 94 for repositioning purposes. After reversing a direction of travel 60 for a determinable distance, the strip of tickets 14 may be, again, advanced along the direction of travel 60 to more accurately align the leading edge 110 of the leading ticket 26 with the optical sensor 94. In this manner, the perforated joints 16 connecting the leading ticket 26 to the strip of tickets 14 may be more accurately positioned by the ticket dispensing machine 10 for severing one or more of the tickets 12 of the strip of tickets 14.

Figure 3:
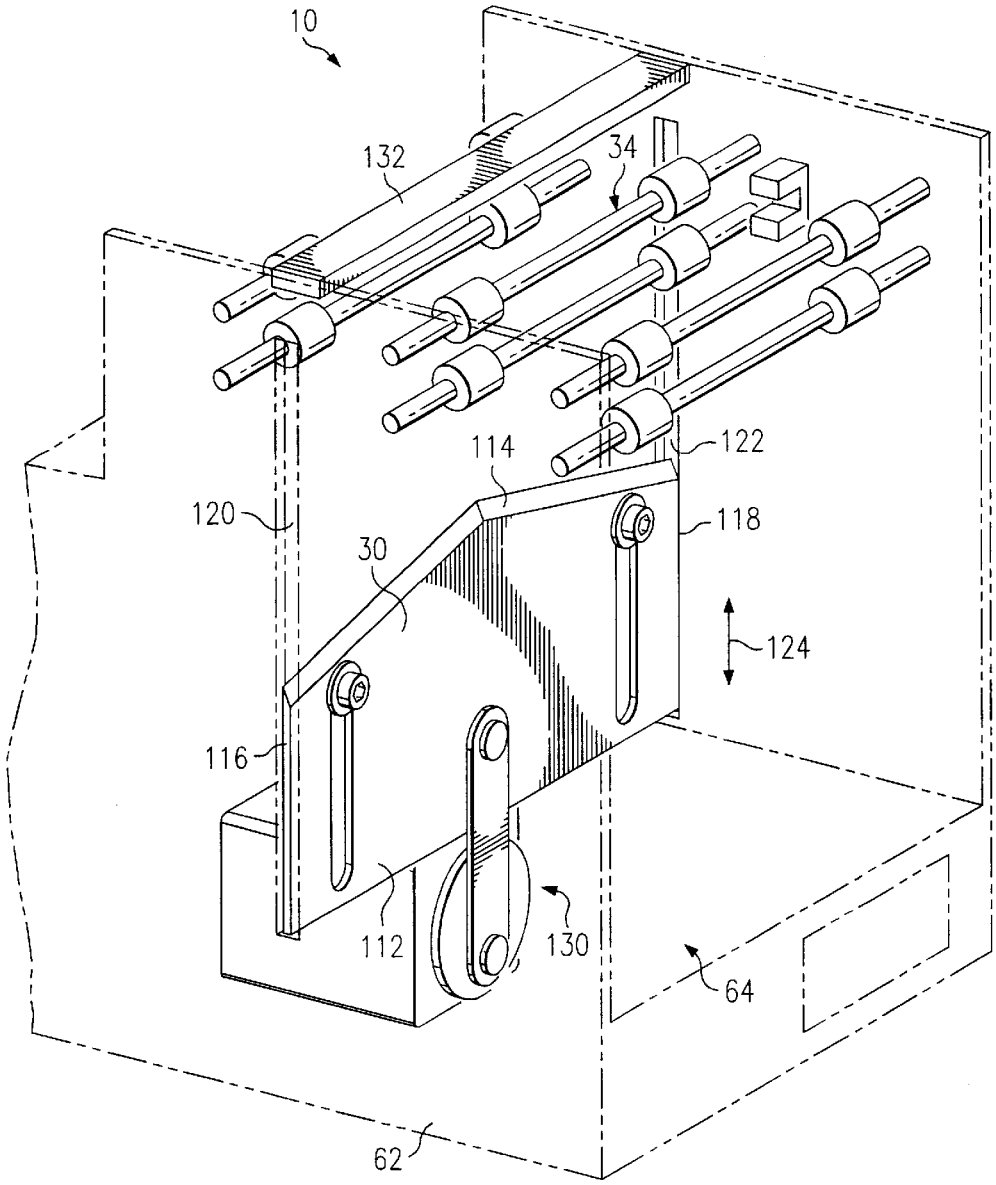
FIG. 3 is a partial cutaway representation of the ticket dispensing machine showing a bursting blade for separating tickets constructed in accordance with one embodiment of the present invention.

FIG. 3 illustrates a frontal view of the ticket dispensing machine 10 with the second stage rollers 34 shown in phantom to more accurately view the bursting blade 30 of the ticket dispensing machine 10. The bursting blade 30 may be constructed from a substantially rigid material, such as a polymeric or metallic material which is operable for striking the strip of tickets 14 along the perforated joints 16 to separate at the leading ticket 26 from the strip of tickets 14.

In one embodiment, the bursting blade 30 is a substantially flat metallic blade provided with a substantially straight lower end 112 and a bursting edge 114 that is angulated substantially so as to be pointed about the center of the bursting edge 114. A first and second sides 116 and 118 of the bursting blade 30, in one embodiment, may be disposed in a first and second groove 120 and 122, respectively, in the sides of the housing 62 of the ticket dispensing machine 10. In this manner, the bursting blade 30 is disposed within the interior area 64 of the housing 62 and is operable to travel in a direction 124 vertically up and down within the interior area 64 of the housing 62.

Figure 4:
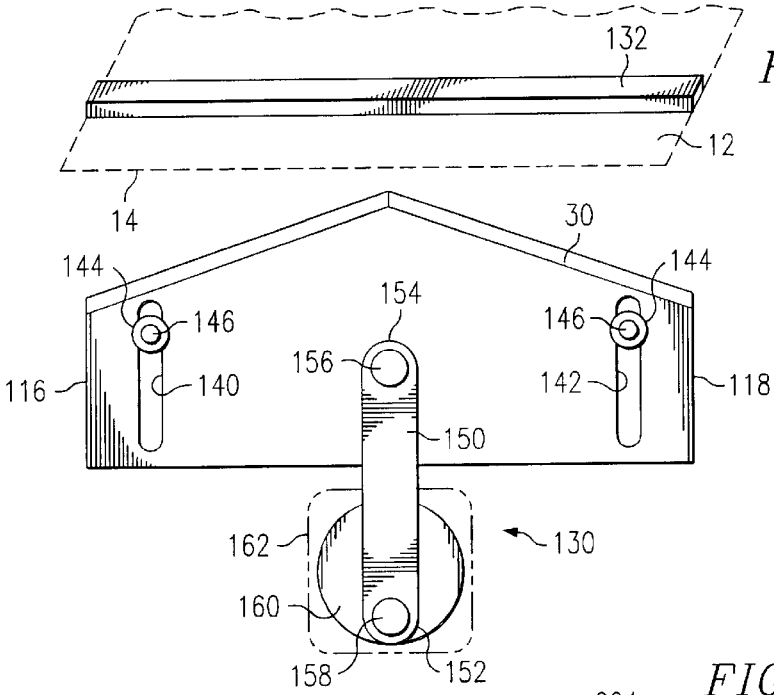
FIG. 4 is a side view of the bursting blade and drive assembly for driving the bursting blade constructed according to another embodiment of the present invention.

FIG. 4 shows the bursting blade 30, a drive assembly 130 adapted to drive the bursting blade 30, and a gauge bar 132. The gauge bar 132 is positioned above the bursting blade 30 so that the strip of tickets 14 passes below the gauge bar 132 and above the bursting blade 30 such that the bursting blade 30 is operable to travel vertically upward toward the gauge bar 132 thereby burstingly separating tickets 12 from the strip of tickets 14. The gauge bar 132 is a substantially rigid cross member extending across the interior area 64 of the housing 62 (see FIG. 3) and acts as a retaining surface for the strip of tickets 14 to prevent the strip of tickets 14 from extending upwardly when contacted by the bursting blade 30 during its vertical travel in the direction 24 toward the strip of tickets 14.

The bursting blade 30 is provided with a first and second slots 140 and 142 defining openings extending through the bursting blade 30 near the first and second sides 116 and 118, respectively, of the bursting blade 30. The bursting blade 30 may be connected to a portion of the housing 62 within the interior area 64 of the housing 62 in a non-rigid fashion via the first and second slots 140 and 142 of the bursting blade 30.

In one embodiment, a pair of shaft members 146 may be connected to the housing 62 within the interior area 64 so as to extend through the slots 140 and 142 and be terminated with a shoulder bolt 144 operable for non-rigid engagement by the shoulder bolt 144 with the bursting blade 30. The bursting blade 30 is thus allowed to travel for bursting engagement with the strip of tickets 14 while the pair of shaft members 146 and shoulder bolts 144 act as a guide for the bursting blade 30 along the first and second slots 140 and 142 of the bursting blade 30 enabling the bursting blade 30 to floatably travel along the direction of travel 204 of the strip of tickets 14.

Figure 5:
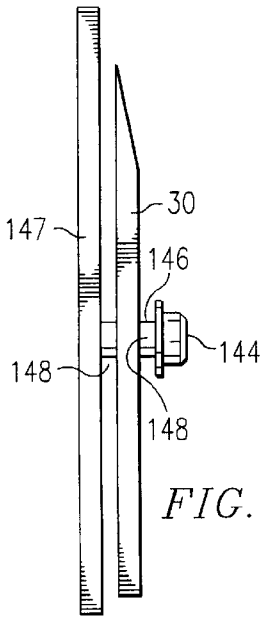
FIG. 5 is a side view of the bursting blade shown in FIG. 4.

Referring also to FIG. 5, a side view of the bursting blade 30 is shown with the shaft member 146 connected to a portion 147 of the housing 62 within the interior area 64 of the housing 62. The shaft member 146 extendable through the first or second slots 140 and 142 of the bursting blade 30. The shoulder bolt 144 non-rigidly connecting the shaft member 146 to the bursting blade 30. It can be seen that this connection provides for gaps 148 along the shaft member 146 between the portion 147 of the housing 62 and the bursting blade 30 as well as between the bursting blade 30 and the shoulder bolt 144. In this manner, the bursting blade 30 is allowed to float about the shaft 146 within the gaps 148 provided therebetween the portion 147 of the housing 62 and the shoulder bolt 144.

Referring again to FIG. 4, the drive assembly 130 includes a cam shaft 150 which is a substantially rigid member having a first end 152 and a second end 154. The second end 154 of the cam shaft 150 is non-rigidly connected, via connector 156, to the bursting blade 30. The first end 152 of the cam shaft 150 is non-rigidly connected, via a connector 158, to a cylindrical member 160. The first end 152 of the cam shaft 150 is connected to the cylindrical member 160 in an off-center fashion providing an eccentric link. A motor 162 (shown in phantom) is connected to the cylindrical member 160 and rotatingly drives the cylindrical member 160 exerts movement upon the cam shaft 150 and the bursting blade 30.

Figure 6:
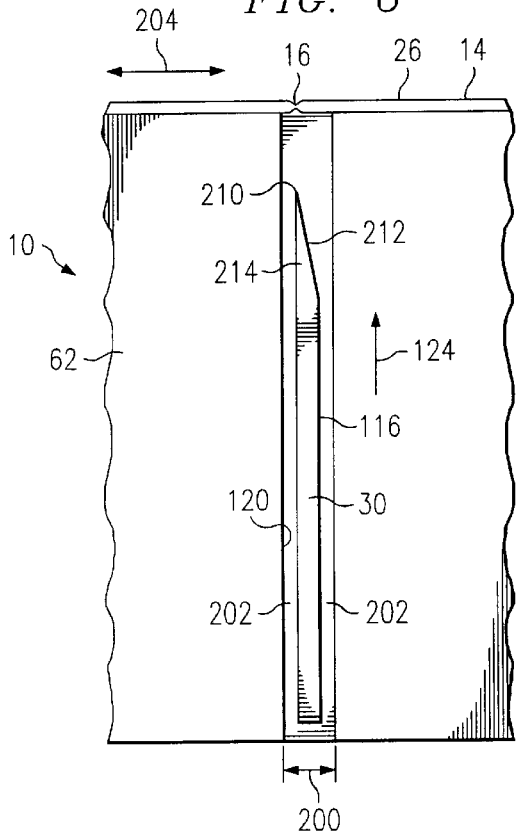
FIG. 6 is a side view of the bursting blade and ticket dispensing machine substantially as shown in FIGS. 3 and 4.

FIG. 6 is a side view of the ticket dispensing machine 10 illustrating the first side 116 of the bursting blade 30 disposed along the first groove 120 of the housing 62. It can be seen that the first groove 120 provides a gap 202 between the first groove 120 and the bursting blade 30. In one embodiment, the gap 202 between the sides of the first groove 120 and the bursting blade 30 is sufficient to allow the bursting blade 30 to float laterally about a direction of travel 204 of the strip of tickets 14.

The advantage of the bursting blade 30 mounted substantially as shown in FIG. 5 and 6, and disposed such that the edges of the bursting blade travel in the non-restrictive first and second grooves 120 and 122 of the housing 62 allows the bursting blade 30 to floatably sense the perforated joints 16 connecting the strip of tickets 14. In this manner, the bursting blade 30 travels in the vertical direction 124 substantially perpendicular to the direct of travel 204 of the strip of tickets 14. The fluid mounting of the bursting blade 30 allows a bursting edge 114, to seek-out the weakest point between two tickets 12 of the strip of tickets 14 such as grooved points along the strip of tickets 14 which typically will be the perforated joint 16 connecting the strip of tickets 14.

Thus, by accurately positioning the perforated joint 16 of the strip of tickets 14 adjacent the bursting blade 30, the advantageous construction and floatable, non-fixed, mounting of the bursting blade 30, as shown in the present embodiment, provides the optimum configuration for accurately separating at least a leading ticket 26 from the strip of tickets 14 along the perforated joints 16 connected therebetween even when the strip of tickets 14 is improperly printed, for example, out of registration.

In one embodiment, the bursting blade 30 may be adapted to cut and sever a leading ticket 26 from the strip of tickets 14 along the perforated joints 16 when ticket printing errors are not a concern. However, in one embodiment, as shown in FIG. 6, the bursting blade 30 strikes the strip of tickets 14 adjacent the perforated joints 16 causing a breaking separation of at least the leading ticket 26 from the strip of tickets 14. Referring also to FIG. 1, it will be appreciated that the function and disposition of the first stage rollers 32 relative to the second stage rollers 34 provides tension along the strip of tickets 14 which promotes a breaking separation of the perforated joint 16 connecting the strip of tickets 14 when the bursting edge 114 portion of the bursting blade 30 impacts the strip tickets 14 adjacent the perforated joint 16.

In one embodiment, to achieve the floatable disposition of the bursting blade 30 for optimal sensing of the weakest point in the strip of tickets 14, the bursting blade 30 should have one-tenth of an inch (1/10") or less floatably about the shoulder bolts 144 and first and second groves 120 and 122 in the side of the housing 62 of the ticket dispensing machine 10. In other embodiments, the floatably may be optimally one-hundredth of an inch (1/100") or less.

This advantageous construction and function overcomes the problem of tickets which are frequently printed out of registration, or the perforations are imperfect, or improperly aligned or scored. Furthermore, the floating disposition of the bursting blade 30 and breaking separation capabilities of the ticket dispensing machine 10 of the present embodiment, by not cutting or severing tickets 12, overcomes the problems incurred where tickets are incorrectly printed or sized in accordance with their generally accepted dimensions.

The bursting blade 30, as shown in FIG. 6, is shown with the bursting edge 114 which is substantially beveled. In one embodiment, the bursting blade 30 is provided with the bursting edge 114 with a first substantially beveled side 212 and a second substantially straight side 214. Such construction of the bursting edge 114 of the bursting blade 30 further assists the bursting blade 30 to floatably sense the perforated joint 16 connecting the strip of tickets 14. This construction allows the bursting edge 114 to sense the weakest point between the tensioned strip of tickets 14 to promote ready separation since the one-way bearing provided in the second stage rollers 34 allow the separated ticket 12 to advance slightly along the ticket path 22 when the bursting edge 114 passes between the tickets 12 while the first stage rollers 32 retain the remaining strip of tickets 14.

However, in other embodiments (not shown) the bursting edge 114 of the bursting blade 30 is provided with both sides being substantially beveled. In some instances, it may be advantageous to have a non-sharp or blunt bursting edge 114 for non-cuttably impacting or striking the strip of tickets 14 for a breaking separation. In other embodiments (not shown), the bursting blade 30 may be disposed so as to impact the strip of tickets 14 at an angulated, non-perpendicular, disposition.

FIG. 7 illustrates one embodiment of an encoder 220 which may be mounted to the lower shaft 40 of the first stage rollers 32 and adapted to sense the rotation of the lower shaft 40. In this manner, the lower shaft 40 of the first stage rollers 32 extends from one side of the housing 62 of the ticket dispensing machine 10.

Referring also to FIG. 8, the encoder 220 is provided with a disk 222 which may be a substantially flat circular metallic or polymeric member provided with detection points such as a plurality of openings 224 extending from a first side 226 through to a second side 228 of the disk 222. The encoder 220 is provided with a photo eye 230 having a first side 232 provided with, for example, a light emitting diode 234. The photo eye 230 has a second side 236 provided with a photoreceptor 238 operable for detecting light emitting from the light emitting diode 234.

In this manner it is readily apparent that as the disk 222 rotates correspondingly with the lower shaft 40 of the first stage rollers 32, light is periodically shown through the openings 224 in the disk 222. As the light emits from the light emitting diode 234 through the openings 224 of the disk 222, the photoreceptor 238 is adapted to detect the light shown through the openings 224 and thereby detect an incremental rotation in the first stage rollers 32.

The photo eye 230 operably counts the pulses for the received light. Computation for determining ticket 12 travel distance must account for variables such as, for example, roller size. In one of embodiment, the disk may be provided with approximately ninety (90) openings 224 while in other embodiments more openings 224 may be advantageous for more exactly sensing the rotation of the first stage rollers 32. While in other embodiments fewer openings 224 in the disk 222 may be satisfactory for such sensing purposes. The photo eye 230 is provided with communication wires 240 operable for communicating information indicating the rotation sensed on the first stage rollers 32.

It will be appreciated that the combination of the encoder 220 and optical sensor 94 provide the ticket dispensing machine 10 with detection mechanisms 24 operable for detecting and, when communicating with the roller assembly 20, positioning the strip of tickets 14 along the ticket path 22 for positioning the perforated joints 16 of the strip of tickets 12 adjacent the bursting blade 30 for separating at least the leading ticket 26 from the strip of tickets 14.

In other embodiments the encoder 220 may be provided to detect the rotation along either the upper or lower shafts 38 and 40 of the first stage rollers 32, as well as, the rotation of the second and third stage rollers 34 and 70. Similarly, while the optical sensor 94 is shown disposed between the second and third stage rollers 34 and 70, it will be appreciated that in some instances it may be advantageous to have additional optical sensors 94 disposed at various points so as to detect the strip of tickets 14 along the ticket path 22. Other placements of the encoder 220 and the optical sensor 94 will readily suggest themselves to one of ordinary skill in the art when provided with the invention as shown and disclosed herein and are within the spirit and scope of the present invention.

Furthermore, other methods of detecting the rotation of the first, second and third stage rollers 32, 34 and 70 may be provided to obtain some of the functional advantages disclosed herein and are within the spirit and scope of the present invention and may include, for example, but not limited to, optical, electrical, mechanical or magnetic rotating detection devices and systems adaptable to detect the rotation of a shaft, such as the lower shaft 40 of the first stage rollers 32.

Figure 9:
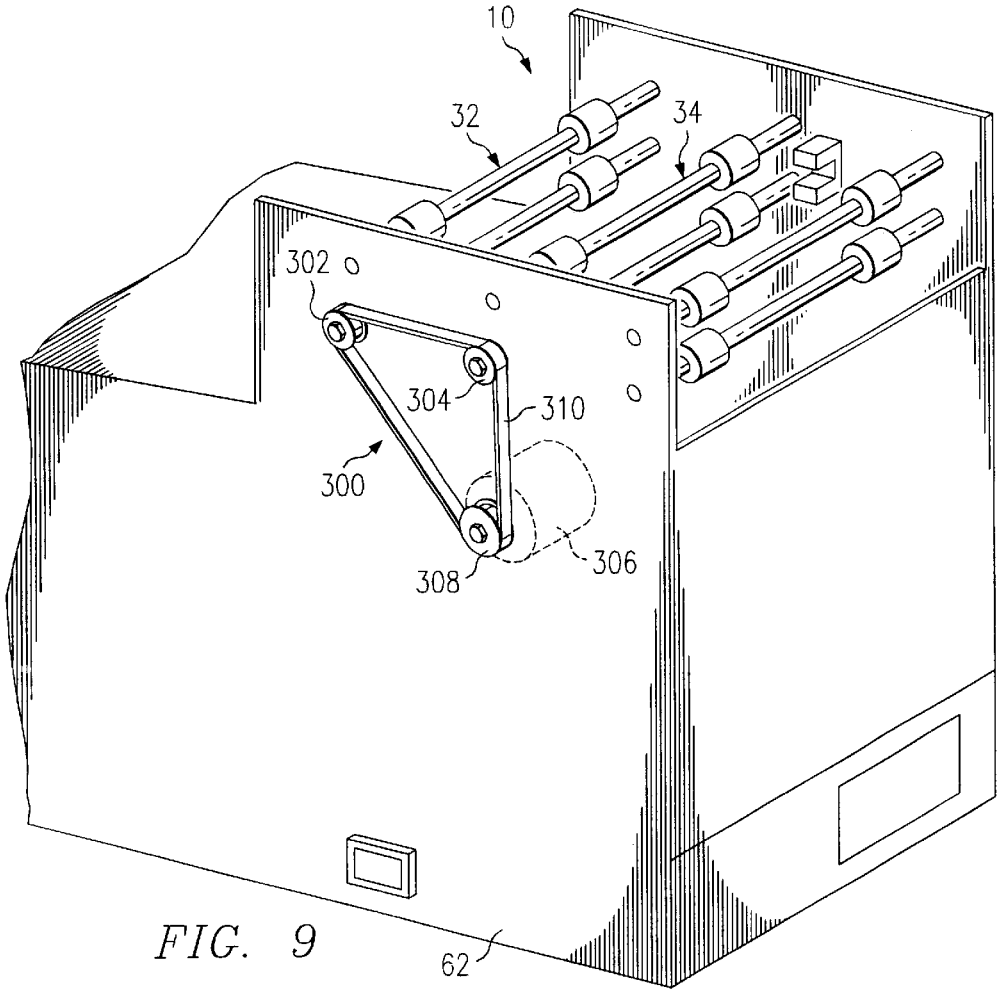
FIG. 9 is a side perspective representation of the drive mechanism for driving a first and second stage rollers of the ticket dispensing machine constructed in accordance with yet another aspect of the present invention.

FIG. 9 illustrates a side view of the ticket dispensing machine 10 showing the drive mechanism 300 operable for driving the first and second stage rollers 32 and 34. The lower shaft 40 of the first stage rollers 32 extends through the side of the housing 62 of the ticket dispensing machine 10 and is provided with a sprocket 302 rotatably connected thereto the lower shaft 40. The sprocket 302 is a substantially cylindrical gearing mechanism which may be provided with a plurality of teeth operable for drivable rotation of the sprockets 302 and connected to impart a rotation to the lower shaft 40.

The sprocket 302 may be constructed from plastic or polymeric material or steel or other metallic materials and may be connected to the lower shaft 40 with a variety of connectors such as a nut and bolt configuration or other connectors that are well known in the art. The drive mechanism 300 is further provided with a second sprocket 304 connected to the lower shaft 52 of the second stage rollers 34. The second sprocket 304 is similar in construction function to the sprocket 302 and operable to rotatably drive the lower shaft 52 of the second stage rollers 34.

The drive mechanism 300 further includes a motor 306 (shown in phantom) which is connected to a drive sprocket 308 and adapted to rotatably drive the drive sprocket 308. The drive sprocket 308 is similar in construction and function to the sprocket 302, however, the drive sprocket 308 may be advantageously provided with a slightly larger diameter than the sprocket 302.

The drive mechanism 300 further includes a belt 310 operably connected to the sprocket 302, the second sprocket 304 and the drive sprocket 308 such that when the motor 306 drives the drive sprocket 308, the belt 310 imparts the rotation on the sprockets 302 and 304 to rotate the first and second stage rollers 32 and 34.

Figure 10:
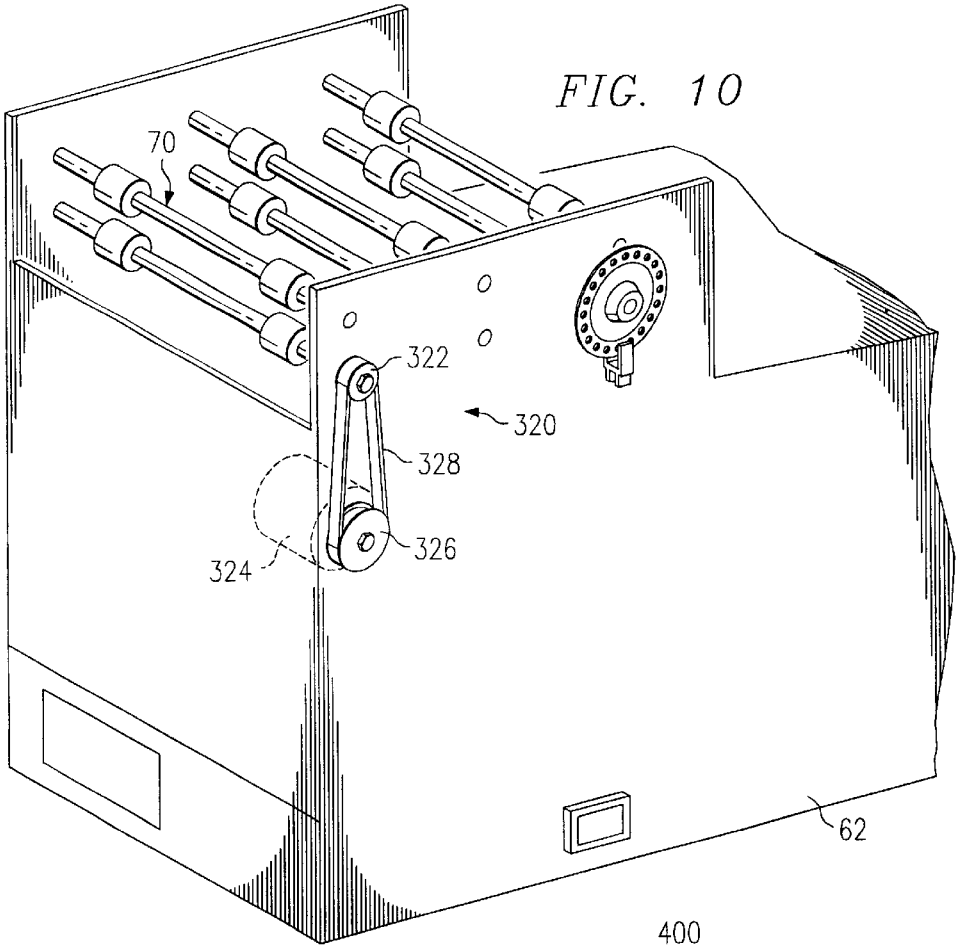
FIG. 10 is a side perspective representation of a second drive mechanism for driving a third stage rollers of the ticket dispensing machine constructed in accordance with yet another embodiment of the present invention.

FIG. 10 illustrates a second drive mechanism 320 operably connected to an adjacent side of the housing 62 relative to the drive mechanism 300. The second drive mechanism 320 includes a sprocket 322 operably connected to the lower shaft 76 of the third stage roller 70 for imparting a rotation on the third stage roller 70. The sprocket 322 is substantially similar in construction and function to the sprocket 302 of the drive mechanism 300.

The second drive mechanism 320 is provided with a motor 324 (shown in phantom) operably connected to a drive sprocket 326 for rotatingly driving the drive sprocket 326. The drive sprocket 326 is substantially similar in function and construction to the drive sprocket 308 with reference to the drive mechanism 300. The second drive mechanism 320 further includes a belt 328 that straps and connects to the sprocket 322 and the drive sprocket 326 such that when the motor 324 imparts a rotation on the drive sprocket 326, it causes the belt 328 to impart a similar rotation on the sprocket 322 for driving the third stage rollers 70.

Figure 11:
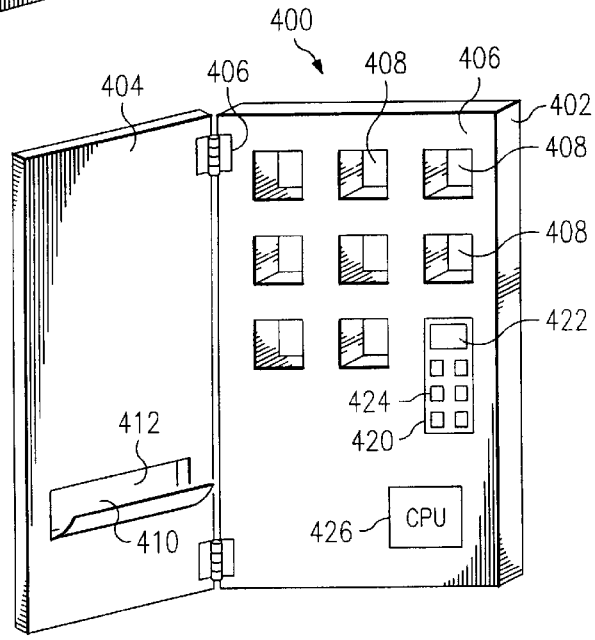
FIG. 11 is a perspective representation of an instant ticket vending machine for receiving a plurality of ticket dispensing machines in accordance with one aspect of the present invention.

FIG. 11 illustrates an instant ticket vending machine 400 operable for dispensing tickets 12, such as lottery tickets. The instant ticket vending machine 400, including a substantially rigid housing 402, having a door 404 connected to the housing 402. The connection of the door 404 to the housing 402 may be accomplished using standard hinges 406 or a variety of other hingeable coupling devices which are well known in the art for connecting doors to housings.

The housing 402 is provided with an inner housing area 406 provided with a plurality of openings 408 adapted to receive the ticket dispensing machine 10 (see FIG. 1). The door 404 of the instant ticket vending machine 400 is provided with a hopper 410 which communicates with an opening 412 in the door 404 of the instant ticket vending machine 400. It is apparent that as the ticket dispensing machine 10, which is operably positioned within one of the openings 408 in the housing 402, dispenses a ticket out of the third stage rollers 70 of the ticket dispensing machine 10, the ticket 12 is ejected into the hopper 410 and may be retrieved when the door 404 is closed through the opening 412 in the door 404.

The instant ticket vending machine 400 is provided with a control panel 420 provided with a display 422 and a variety of selectors 424 such that an individual may select, via the selectors 424, a particular type of ticket 12 contained in a particular ticket dispensing machine 10 retained within the housing 402 of the instant ticket vending machine 400. The control panel 420 and selectors 424 may include additional capabilities such as, for example, a keypad, card-reader or other input capabilities and money receiver and changers.

Figure 12:
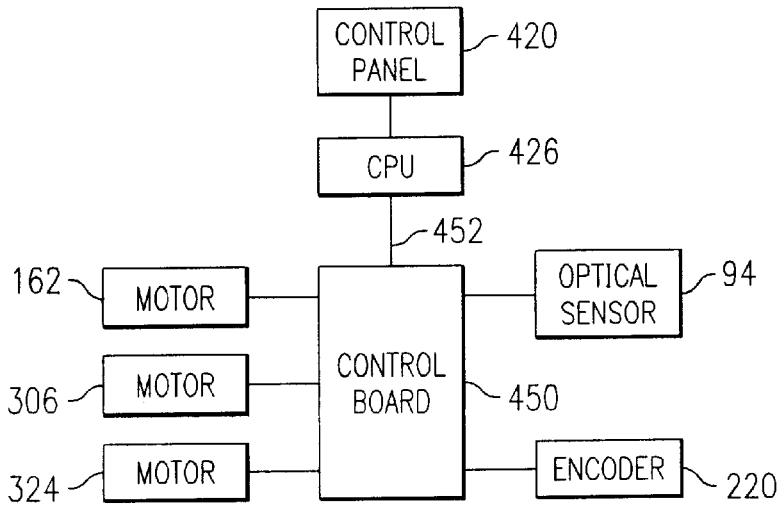
FIG. 12 is a block diagram showing a central processing unit of the instant ticket vending machine and a control board of the ticket dispensing machine constructed in accordance with one embodiment of the present invention.

Referring also to FIG. 12, the control panel 420 is in communication with a CPU (central processing unit) 426 of the instant ticket vending machine 400. The CPU 426 of the instant ticket vending machine 400 is in communication with a control board 450 (see FIG. 1) provided on the bottom, or underside, of the ticket dispensing machine 10. In this manner, when the CPU 426 receives input from the control panel, for example, as a keypad input indicative of a user selecting a specific ticket type, the CPU 426 communicates with the appropriate ticket vending machine 10, via the control board 450 of the particular ticket dispensing machine 10.

The CPU 426 of the instant ticket vending machine 400 communicates with the control board 450 of the ticket dispensing machine 10 via a communication line 452. The communication line 452 may be a RS485 connection or other communication lines adapted for providing communication signals for these purposes. The control board 450 further communicates with the motor 162 of the drive assembly 130 operable for driving the bursting blade 30. The control board 450 further communicates with the motor 306 of the drive mechanism 300 operable for driving the first and second stage rollers 32 and 34. The control board 450 further communicates with the motor 324 of the second drive mechanism 320 operable for driving the third stage rollers 70.

The control board 450 further communicates with the detection mechanism 24 which may include the optical sensor 94 and the encoder 220. The control board 450 of the ticket dispensing machine 10 further includes a dip switch (not shown) indicating a unique address or location within the instant ticket vending machine 400 of each particular ticket dispensing machine 10 relative to other ticket dispensing machines 10 disposed in the openings 408 of the instant ticket vending machine 400.

The CPU 426 of the instant ticket vending machine 400 contains information relative to the ticket length and size of the tickets 12 of the strip of tickets 14 loaded within the tray 90 of the ticket dispensing machine 10. In this manner, the strip of tickets 14 is loaded into the first stage rollers 32 and there through the second stage rollers 34 until the optical sensor 94 detects the leading edge 110 of the leading ticket 26 of the strip of tickets 14. The optical sensor 94 communicates with the control board 450 which obtains ticket length information from the CPU 426 and communicates with the motor 306 to stop, reverse and then re-advance the strip of tickets 14 along the ticket path 22 for positioning.

In one embodiment, the reversal and re-advancement of the strip of tickets 14 is only accomplished during the initial loading for accurately and consistently positioning the strip of tickets 14. Thereafter, the strip of tickets 14 are advanced until detected by the optical sensor 94, with the assistance of the encoder 220, for proper positioning without the need to reverse and re-advance the strip of tickets 14.

As the motor 306 rotates the first stage rollers 32, the encoder 220 measures the amount of rotation of the first stage rollers 34 and, based upon the ticket length information obtained from the CPU 426, the motor 306 receives a signal from the control board 450. The motor 306 then drives the first and second stage rollers 32 and 34 which advance the strip of tickets 14 wherein the perforated joints 16 of the strip of tickets 14 are adjacent the bursting blade 30 for separation. Once the strip of tickets 14 have been properly aligned, the control board 450 sends a signal to the motor 162 which causes the bursting blade 30 to strike the strip of tickets 14 adjacent the perforated joints 16 to break the perforated joints 16 connecting at least the leading ticket 26 to the strip of tickets 14.

The control board 450 sends a signal to the motor 306 to advance the first and second stage rollers 32 and 34 causing the separated ticket 12 to advance to the third stage rollers 70. The control board 450 then sends a signal to the motor 324 which drives the third stage rollers 70 causing the separated ticket 12 to be ejected therefrom the ticket dispensing machine 10 and into the hopper 410 of the instant ticket vending machine 400.

In one embodiment, once the strip of tickets 14 has been cut by the bursting blade 30, a trailing edge (not shown) of the ticket 12 is detected by the optical sensor 94. The optical sensor 94 communicates such information to the control board 450. The control board 450 communicates with the motor 306 to stop the second stage rollers 34 and then communicates with the motor 324 to drive the third stage rollers 70 causing the ticket to eject. In this manner, the motors are driven individually for optimum performance and control.

In one embodiment, when the door 404 of the instant ticket vending machine 400 is opened, the CPU 426 initiates a service mode operable for a user to communicate information about the of tickets 12 being loaded. In this manner, the control panel 420 operably provides the user with a menu for entering information such as ticket length, ticket price and the quantity of tickets loaded in a particular ticket dispensing machine 10 disposed within the opening 408 of the instant ticket vending machine 400. Additionally, the user may obtain information and reports of ticket dispensing activities, including security features.

Information such as the cost of tickets, charge for tickets and other general information for the consumer or user of the instant ticket vending machine 400 may be displayed on the display 422 of the control panel 420. Additionally, it may be advantageous to display information on the ticket dispensing machine 10, including the cost of tickets, the number of tickets remaining or vended in a particular ticket vending machine 10 and, in such event, a display 475 (see FIG. 1) may be provided on the front of the ticket dispensing machine 10 adapted for such purposes.

In other embodiments, the ticket vending machine 10 is provided with a load switch 480 (see FIG. 1) mounted on the housing 62 of the ticket vending machine 10. The load switch 480 communicates with the control board 450 for manually initiating at least the motor 306 for driving the first and second stage rollers 32 and 34 to initially load or, by reversing the motor 306, unload the strip of tickets 14.

It will be appreciated that the use of rollers having one-way bearings, such as the pinch rollers 36 of the first stage rollers 32, is useful for vending tickets of varying lengths to allow motors 306 and 324 to be driven at different times to dispense tickets 12 of different sizes, such as tickets 12 having lengths of up to twelve inches (12").

Figure 13:
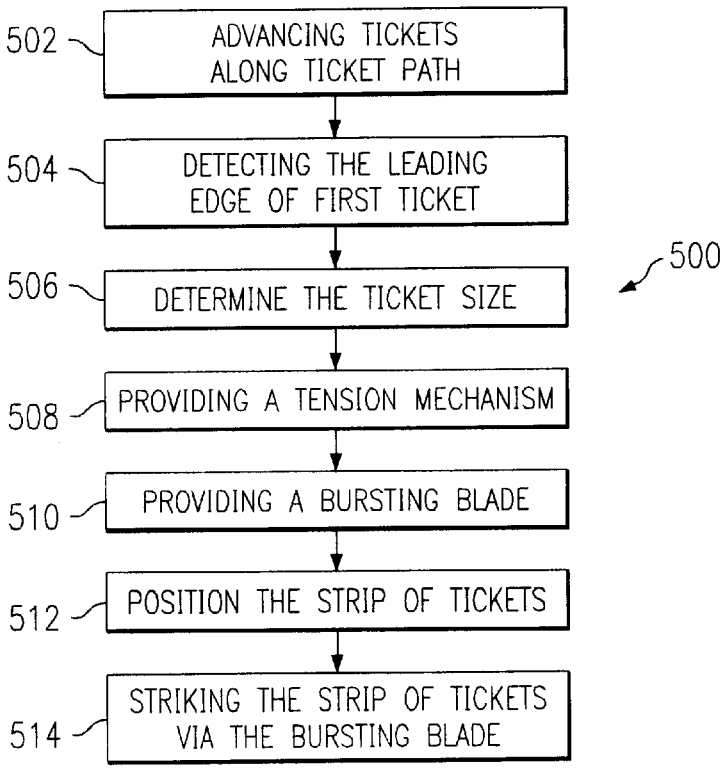
FIG. 13 is a flow chart describing a method of separating tickets from strip of tickets connected along perforated joints provided in accordance with one embodiment of the present invention.

FIG. 13 illustrates a flow-chart of a method 500 of separating tickets 12 from a strip of tickets 14 connected along perforated joints 16. The method provides, at a block 502 for advancing the strip of tickets 14 along the ticket path 22. At a block 504, the method provides for detecting the leading edge 110 of at least the leading ticket 26 of the strip of tickets 14. At a block 506, the method provides for determining the ticket size of at least the leading ticket 26 of the strip of tickets 14. At a block 508, the method provides a tensioning mechanism operative to tension at least a portion of the ticket path 22 at a perforated joint 16 connecting at least a leading ticket 26 to the strip of tickets 14.

At a block 510, the method includes providing a bursting blade 30 adapted to float relative to the direction of travel of the strip of tickets 14 along the ticket path 22. At a block 512, the method includes positioning the strip of tickets 14 relative to the bursting blade 30 for separation. At a block 514, the method includes striking, via the bursting blade 30, the strip of tickets 14 adjacent the tension portion of the ticket path 22 adjacent the perforated joints 16 connecting at least the leading ticket 26 to the strip of tickets 14 to separate the leading ticket 26 from the strip of tickets 14. The severed ticket 12 may then be advanced, in another embodiment, from the second stage rollers 34 to the third stage rollers 70 which eject the ticket 12 into the hopper 410 of the instant ticket vending machine 400.

Thus, it is apparent that there has been provided, in accordance with the present invention, an apparatus and method for dispensing tickets that satisfies one or more of the advantages set forth above. Although the preferred embodiment has been described in detail, it should be understood that various changes, substitutions, and alterations can be made herein without departing from the scope of the present invention, even if all of the advantages identified above are not present. For example, the various embodiments shown in the drawings herein illustrate that the present invention may be implemented and embodied in a variety of different ways that still fall within the scope of the present invention.

Also, the techniques, designs, elements, and methods described and illustrated in the preferred embodiment as discrete or separate may be combined or integrated with other techniques, designs, elements, or methods without departing from the scope of the present invention. Other examples of changes, substitutions, and alterations are readily ascertainable by one skilled in the art and could be made without departing from the spirit and scope of the present invention.

What is claimed is:

1. A ticket machine for dispensing tickets from a strip of tickets having perforated lines of weakness between adjacent tickets, the ticket machine comprising;

a roller assembly adapted to drive a portion of the strip of tickets along a ticket path;

a detection mechanism disposed adjacent the ticket path and adapted to determine a position of the strip of tickets along the ticket path;

the roller assembly being arranged to be driven in response to the detection mechanism to locate a line of weakness substantially at a bursting position;

a bursting blade having a bursting edge located at the bursting position adjacent the ticket path and arranged for operation in a bursting action;

wherein the roller assembly includes a first set of pinch rollers upstream of the bursting position and a second set of pinch rollers downstream of the bursting position arranged to hold the tickets tensioned across the bursting position;

wherein the first and second set of pinch rollers are driven by a common motor at common speed;

wherein the roller assembly includes a third discharge set of pinch rollers along the ticket path downstream from the second pinch rollers and arranged to receive tickets directly from the second set of pinch rollers, the third discharge set of pinch rollers being driven by a motor separately from the first and second set of pinch rollers;

and wherein the detection mechanism is positioned along the ticket path upstream of the third discharge set of pinch rollers.

2. The ticket machine of claim 1 wherein the second set of pinch rollers is provided with one-way bearings operable to inhibit a ticket pinched therein from a reverse travel direction along the ticket path while allowing the ticket pinched therein to travel forwardly along the ticket path.

3. The ticket dispenser of claim 1 wherein the first set of pinch rollers include a rotatable drive shaft driven by a motor and wherein there is provided an encoder adapted to sense the rotation of the drive shaft.

4. The ticket dispenser of claim 1 wherein the detection mechanism is adapted to sense a leading edge of the leading ticket of the strip of tickets and is positioned along the ticket path downstream of the second set of pinch rollers.

5. The ticket machine of claim 1 wherein the bursting blade has a flat surface on the upstream side and a beveled bursting edge on the downstream side.

6. The ticket machine of claim 1 wherein there is provided a gauge bar on a side of the tickets opposite to the bursting blade edge, the gauge bar being located upstream of the bursting blade edge.

7. The ticket machine of claim 1 wherein there is defined a stop position at or adjacent the detection mechanism and wherein the distance from the stop position to the third discharge set of pinch rollers is no greater than the distance from the bursting blade to the stop position.

8. The ticket machine of claim 1 wherein the bursting blade has an edge defining a central apex midway across the line of weakness and is declined from the central apex outwardly and away from ticket so as to strike the line of weakness initially at the center.

9. The ticket dispenser of claim 1 wherein the third discharge set of pinch rollers is arranged to discharge a separated ticket directly into a receptacle for supply to a user.

10. A ticket machine for dispensing tickets from a strip of tickets having perforated lines of weakness between adjacent tickets, the ticket machine comprising:

a roller assembly adapted to drive a portion of the strip of tickets along a ticket path;

a detection mechanism disposed adjacent the ticket path and adapted to determine a position of the strip of tickets along the ticket path;

the roller assembly being arranged to be driven in response to the detection mechanism to locate a line of weakness substantially at a bursting position;

a bursting blade having a bursting edge located at the bursting position adjacent the ticket path with the bursting edge extending across the path of the tickets;

the bursting blade being mounted on a mounting guide assembly for movement of the edge toward the tickets in a bursting action through the line of weakness to separate a ticket on one side of the line of weakness from a ticket on the other side of the line of weakness;

the mounting guide assembly defining a space relative to the blade such that the bursting blade is mounted thereon for limited floating movement of the edge in a direction forwardly and rearwardly along the path of the tickets so as to allow movement of the edge to the line of weakness when misaligned with the bursting position.

11. The ticket machine of claim 10 wherein the bursting blade has an edge defining a central apex midway across the line of weakness and is declined from the central apex outwardly and away from the line of weakness so as to strike the line of weakness initially at the center.

12. The ticket machine of claim 10 wherein there is provided a gauge bar on a side of the tickets opposite to the bursting blade edge, the gauge bar being located upstream of the bursting blade edge.

13. The ticket machine of claim 10 wherein the bursting blade has a flat surface on the upstream side and a beveled bursting edge on the downstream side.

14. The ticket machine of claim 10 wherein the roller assembly includes a first set of pinch rollers upstream of the bursting position and a second set of pinch rollers downstream of the bursting position arranged to hold the tickets tensioned across the bursting position.

15. The ticket machine of claim 14 wherein the first and second set of pinch rollers are driven by a common motor at common speed.

16. The ticket machine of claim 14 wherein the second set of pinch rollers are provided with one-way bearings operable to inhibit a ticket pinched therein from a reverse travel direction along the ticket path while allowing the ticket pinched therein to travel forwardly along the ticket path.

17. The ticket dispenser of claim 14 wherein the first set of pinch rollers include a rotatable drive shaft driven by a motor and wherein there is provided an encoder adapted to sense the rotation of the drive shaft.

18. The ticket dispenser of claim 14 further provided with a third discharge set of pinch rollers along the ticket path downstream from the second pinch rollers for discharging a separated ticket into a receptacle for supply to a user.

19. The ticket machine of claim 18 wherein the detection mechanism is adapted to sense a leading edge of the leading ticket of the strip of tickets and is positioned along the ticket path downstream of the second set of pinch rollers and upstream of the third set of pinch rollers.

20. The ticket dispenser of claim 18 wherein the third discharge set of pinch rollers is driven by a motor separately from the first and second sets of pinch rollers and includes one way bearings arranged to allow forward rotation of the third discharge set of pinch rollers.

21. A ticket machine for dispensing tickets from a strip of tickets having perforated lines of weakness between adjacent tickets, the ticket machine comprising;

a roller assembly adapted to drive a portion of the strip of tickets along a ticket path;

a detection mechanism disposed adjacent the ticket path and adapted to determine a position of the strip of tickets along the ticket path;

wherein the roller assembly includes a first set of pinch rollers upstream of the bursting position and a second set of pinch rollers downstream of the bursting position arranged to hold the tickets tensioned across the bursting position;

a common motor and a connection from the common motor to the first and second set of pinch rollers arranged to drive the first and second set of pinch rollers at common speed;

the operation of the common motor being controlled in response to the rotation of the first set of pinch rollers and in response to the detection mechanism to drive the first set of pinch rollers so as to move the strip of tickets to locate a line of weakness of the strip of tickets substantially at a bursting position;

a bursting blade having a bursting edge located at the bursting position adjacent the ticket path and arranged for operation in a bursting action;

wherein the second set of pinch rollers is provided with one-way bearings operable to inhibit a ticket pinched therein from a reverse travel direction along the ticket path while allowing the ticket pinched therein to travel forwardly along the ticket path.

22. The ticket machine of claim 21 wherein the bursting blade has an edge defining a central apex midway across the line of weakness and is declined from the central apex outwardly and away from the line of weakness so as to strike the line of weakness initially at the center.

23. The ticket machine of claim 21 wherein there is provided a gauge bar on a side of the tickets opposite to the bursting blade edge, the gauge bar being located upstream of the bursting blade edge.

24. The ticket machine of claim 21 wherein the bursting blade has a flat surface on the upstream side and a beveled bursting edge on the downstream side.

25. The ticket dispenser of claim 21 wherein the first set of pinch rollers include a rotatable drive shaft driven by a motor and wherein the rotation of the first set of pinch rollers is detected by an encoder adapted to sense the rotation of the drive shaft.

26. The ticket dispenser of claim 21 further provided with a third discharge set of pinch rollers along the ticket path downstream from the second pinch rollers for discharging a separated ticket into a receptacle for supply to a user.

27. The ticket machine of claim 26 wherein the detection mechanism is adapted to sense a leading edge of the leading ticket of the strip of tickets and is positioned along the ticket path downstream of the second set of pinch rollers and upstream of the third discharge set of pinch rollers.

28. The ticket dispenser of claim 26 wherein the third discharge set of pinch rollers are driven by a motor separately from the first and second sets of pinch rollers and include one way bearings arranged to allow forward rotation of the third set of pinch rollers.

* * * * *